US008272147B2

(12) United States Patent
Jeong

(10) Patent No.: US 8,272,147 B2
(45) Date of Patent: Sep. 25, 2012

(54) STRUCTURE OF MULTI-ELASTIC INSOLE FOR SHOES

(75) Inventor: Yong Chae Jeong, Busan (KR)

(73) Assignee: I-Masti Co., Ltd (KR)

( * ) Notice: Subject to any disclaimer, the term of this patent is extended or adjusted under 35 U.S.C. 154(b) by 535 days.

(21) Appl. No.: 12/599,090

(22) PCT Filed: Oct. 5, 2007

(86) PCT No.: PCT/KR2007/004875

§ 371 (c)(1),
(2), (4) Date: Nov. 6, 2009

(87) PCT Pub. No.: WO2008/136559

PCT Pub. Date: Nov. 13, 2008

(65) Prior Publication Data

US 2010/0218399 A1 Sep. 2, 2010

(30) Foreign Application Priority Data

May 7, 2007 (KR) ..... 10-2007-0044117

(51) Int. Cl.
*A43B 13/38* (2006.01)

(52) U.S. Cl. ..... 36/44; 36/37; 36/174

(58) Field of Classification Search ..... 36/44, 37, 36/174, 80, 166, 172, 173, 180, 181
See application file for complete search history.

(56) References Cited

U.S. PATENT DOCUMENTS

| | | | | |
|---|---|---|---|---|
| 4,823,420 | A * | 4/1989 | Bartneck | 12/142 N |
| 5,068,983 | A * | 12/1991 | Marc | 36/44 |
| 6,205,684 | B1 * | 3/2001 | Snyder | 36/35 R |
| 6,381,875 | B2 * | 5/2002 | Singer et al. | 36/28 |
| 7,010,870 | B2 * | 3/2006 | Mick et al. | 36/44 |
| 7,484,319 | B2 * | 2/2009 | Cheskin et al. | 36/44 |
| 2002/0007569 | A1 * | 1/2002 | Crane et al. | 36/44 |
| 2004/0181971 | A1 * | 9/2004 | Turkbas et al. | 36/44 |
| 2007/0234592 | A1 * | 10/2007 | Crates | 36/44 |
| 2010/0095551 | A1 * | 4/2010 | Gupta et al. | 36/29 |
| 2010/0275468 | A1 * | 11/2010 | Shelton et al. | 36/3 B |
| 2011/0131835 | A1 * | 6/2011 | Cheskin et al. | 36/44 |

FOREIGN PATENT DOCUMENTS

| | | | |
|---|---|---|---|
| JP | 07-177901 | A | 7/1995 |
| JP | 07-1177901 | A | 7/1995 |
| KR | 10-2004-0089055 | A | 10/2004 |
| KR | 20-0370556 | | 12/2004 |
| KR | 20-0427686 | | 9/2006 |

* cited by examiner

*Primary Examiner* — Ted Kavanaugh

(74) *Attorney, Agent, or Firm* — John K. Park; Park Law Firm

(57) ABSTRACT

The present invention relates to a structure of a multi-elastic insole for shoes wherein a plurality of polyurethane foams having different elasticity from one another are sequentially laminated on the concaved portion of the bottom surface of an insole abutting against a wearer's heel portion, thereby excellently absorbing the impacts generated from a foot sole to make the wearer feel comfortable while in use, which reduces the work load of the leg and foot and the muscle fatigue in the workers standing up for long hours on a hard floor and prevents the muscular skeletal diseases to make the workers healthy.

2 Claims, 2 Drawing Sheets

[Fig. 1]
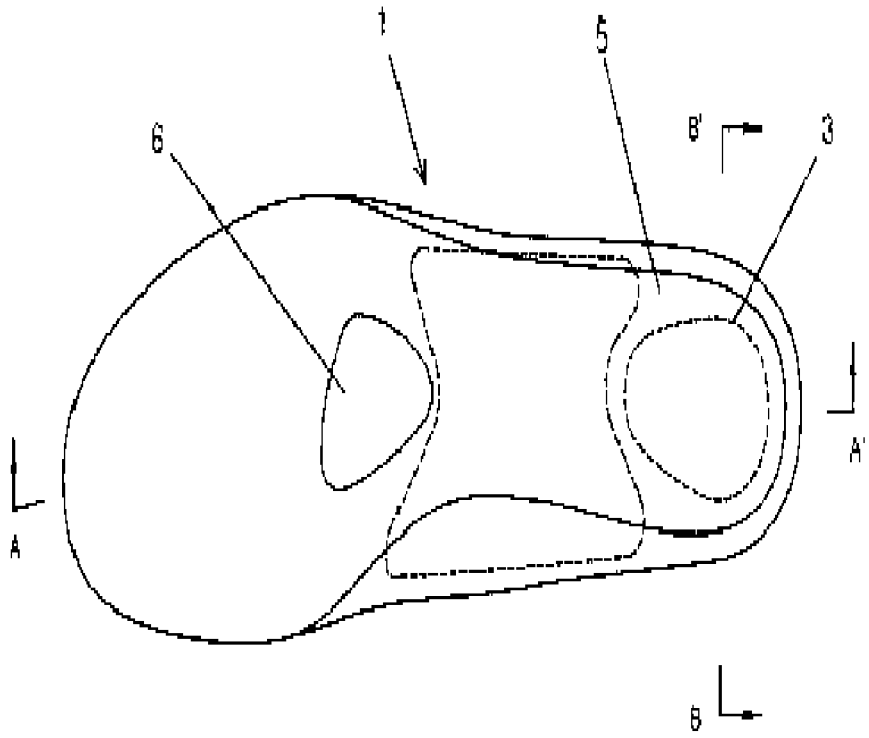
[Fig. 2]
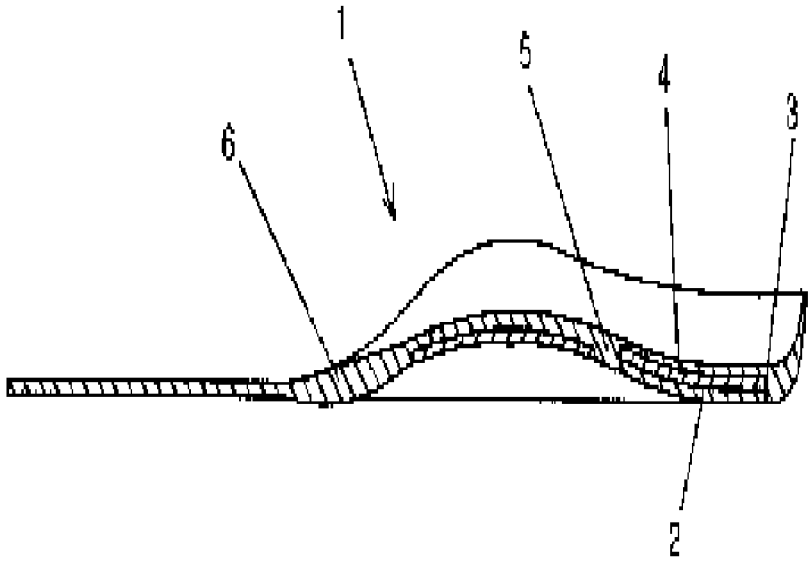

[Fig. 3]
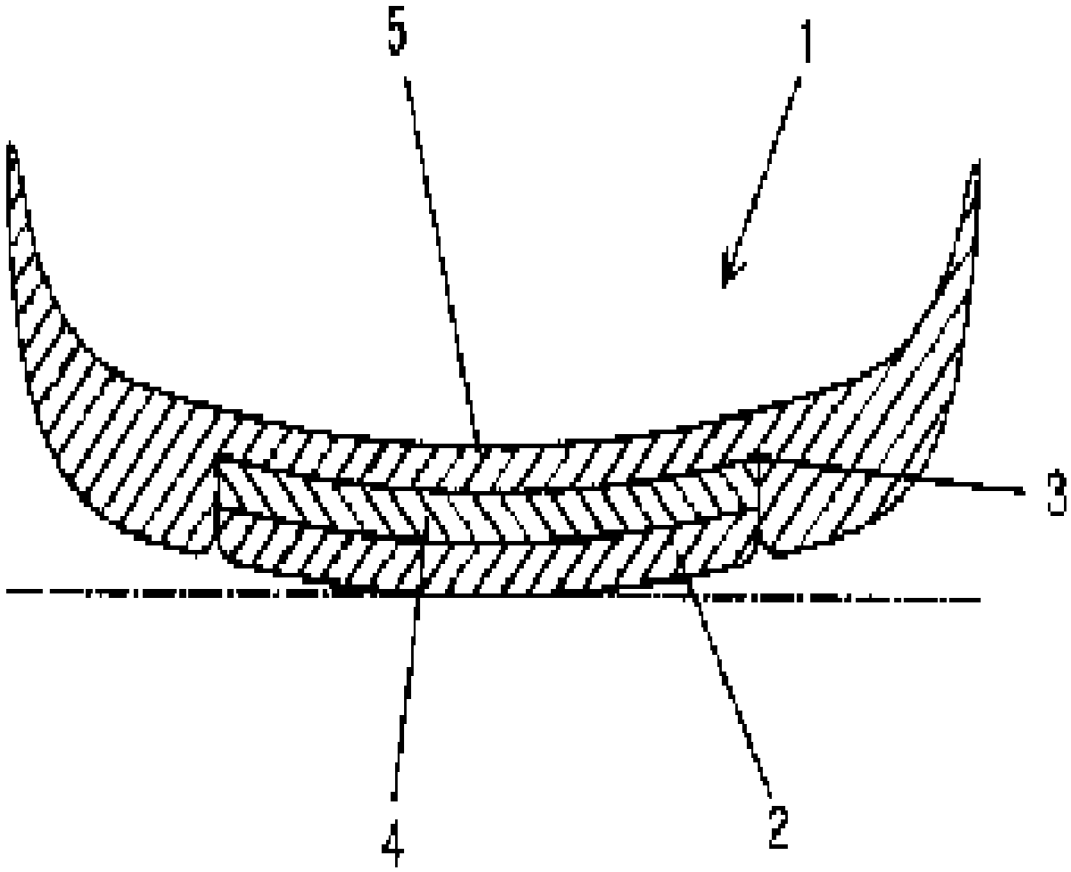

STRUCTURE OF MULTI-ELASTIC INSOLE FOR SHOES

TECHNICAL FIELD

The present invention relates to a structure of a multi-elastic insole for shoes, and more particularly, to a structure of a multi-elastic insole for shoes wherein high, mid and low, elasticity polyurethane foams are sequentially laminated on the bottom surface of the insole abutting against a wearer's heel portion, so that they serve to distribute the wearer's body pressure (foot pressure) while in use, thereby releasing the impacts applied to the wearer's foot sole and reducing the fatigue of the wearer's muscles.

BACKGROUND ART

Generally, most of insoles for shoes, which have a polyurethane material formed integrally on the bottom side of the surface made of fabric, are fitted inside the shoe. However, they fail to fully absorb the impacts applied by the gravity generated while a wearer is walking or running and further add much load to joints of ankles and knees by the repulsion from the ground caused by high elasticity of the polyurethane material.

Recently, furthermore, peoples who work in automated industrial fields, without lots of movements, peoples who stand up to use a laser scanner in front of counters at marts for long hours, peoples who stand up to work for long hours while raising their arms and fixing their eyes to a given position at hair shops, have suffered serious pains on their muscular skeletal system.

Most of them feel the pain on their feet and further on their legs. Unfortunately, their pain is extended even to their waist, which of course gives bad influences on their entire body.

DISCLOSURE OF INVENTION

Technical Problem

To solve these problems, accordingly, it is an object of the present invention to provide a structure of a multi-elastic insole for shoes wherein high, mid and low elasticity polyurethane foams are sequentially laminated on a concaved portion of the bottom surface of the insole abutting against a wearer's heel portion, thereby excellently absorbing the impacts generated from a foot sole to make the wearer feel comfortable while in use, which reduces the leg and foot fatigue of the workers standing up for long hours on a hard floor so as to release the impacts applied to their muscular skeletal system.

Technical Solution

To achieve the above object, there is provided a structure of a multi-elastic insole for shoes including: a low elasticity polyurethane foam 5 disposed on the top side of the insole 1; a high elasticity polyurethane foam 2 and a mid elasticity polyurethane foam 4 sequentially laminated at the inside of a generally oval concaved portion 3 formed on the bottom surface of the insole 1 abutting against a wearer's heel portion; and a foot arch base 6 formed integrally with the insole 1 in such a manner as to be protruded from the middle portion of the insole 1.

Advantageous Effects

The present invention relates to a structure of a multi elasticity insole for shoes wherein high, mid and low elasticity polyurethane foams are sequentially laminated on the bottom surface of the insole abutting against a wearer's heel portion, thereby excellently absorbing the impacts generated from the wearer's foot sole while working for long hours at a state of standing up on a hard floor to make the wearer feel comfortable, which reduces the wearer's leg and foot fatigue and prevents the increasing rate of the foot pressure.

BRIEF DESCRIPTION OF THE DRAWINGS

FIG. 1 is a plane view showing a structure of a multi-elastic insole for shoes according to the present invention.

FIG. 2 is a sectional view taken along the line A-A of FIG. 1.

FIG. 3 is a sectional view taken along the line B-B of FIG. 1.

BEST MODE FOR CARRYING OUT THE INVENTION

Hereinafter, an explanation of a structure of a multi-elastic insole for shoes according to the present invention will be given with reference to the attached drawings. The present invention will be described with reference to a particular illustrative embodiment, and therefore, it is not to be restricted by the embodiment but only by the appended claims.

1. Manufacturing of Insole

A variety of insole samples were made as listed below in Table 2 by using three different elasticity polyurethane foams as listed below in Table 1.

TABLE 1

| Division | Color | Elasticity [1)] |
|---|---|---|
| Low elasticity (L) | Red (R) | 4 (3~10) |
| Mid elasticity (M) | Blue (B) | 15 (10~20) |
| High elasticity (H) | Yellow (Y) | 25 (20~30) |

Note
[1)] shore instrument. resiliometer (ASTM D 2632)

TABLE 2

| Insole | Color | Elasticity |
|---|---|---|
| Sample 1 | R-B-Y | L-M-H |
| Sample 2 | R-Y-B | L-H-M |
| Sample 3 | B-R-Y | M-L-H |
| Sample 4 | B-Y-R | M-H-L |
| Sample 5 | Y-R-B | H-L-M |
| Sample 6 | Y-B-R | H-M-L |
| Control group | No insole | No insole |

2. Measuring Method

First, seven healthy men in the second decade having no muscular skeletal diseases on their waist and legs in the past and no deformation in their feet shape were chosen to wear the shoes with the insole made of polyurethane foams having the colors and elasticity as listed in Table 2 and the shoes (control group) with no insole mounted therein, and then, they walked for two hours. After that, their foot pressures and electromyogram (EMG) were measured.

3. Measuring Items

A. Measurement of Foot Pressure a) Average Pressure Measurement of Insoles for Analyzing Foot Pressure The average pressure for the samples 1 to 6 and the control group was measured at 0 hours and 2 hours after walking, so that all of the insoles showed higher foot pressures at 2 hours than at 0 hours, as shown in Table 3. Therefore, it could be appreciated that as time elapsed, the foot pressure was increased.

The increasing rate of the foot pressure for each insole was analyzed to find the elasticity foam combination of the insole having a lowest value.

TABLE 3

| Hours | Insole | Average(kpa) | Force (F) | p- value |
|---|---|---|---|---|
| 0 hour | Samples 1~6 | 108.28 | 22.82 | 0.000* |
| | Control group | 133.72 | | |
| 2 hours | Samples 1~6 | 111.87 | 56.78 | 0.000* |
| | Control group | 154.57 | | |

*is reliability of $p < 0.05$

As appreciated from Table 3, at 0 hours and 2 hours, the multi-elastic insole samples 1 to 6 had a significantly lower value at the reliability of $p<0.05$ than the control group having no insole mounted therein.

b) Comparison Among the Multi-elastic Insole Samples at 0 Hours and 2 Hours After Walking a') Comparison Among the Multi-elastic Insole Samples at 0 Hours After Walking As appreciated from Table 4 listed below, the insole sample 2 and the insole sample 3 had relatively low values of 96.66 kpa and 93.72 kpa in the average foot pressures, having no significant difference at the reliability of $p<0.05$ between them. However, there was a significant difference at the reliability of $p<0.05$ among the multi-elastic insole samples 1 to 6.

b') Comparison Among the Multi-elastic Insole Samples at 2 Hours After Walking

As appreciated from Table 4, the insole sample 2 and the insole sample 3 had relatively low values of 98.72 kpa and 94.58 kpa in the average foot pressures, having no significant difference at the reliability of $p<0.05$ between them. However, there was a significant difference at the reliability of $p<0.05$ among the multi-elastic insole samples 1 to 6.

TABLE 4

| Significance of each insole at 0 hour | | | Significance of each insole at 2 hours | | |
|---|---|---|---|---|---|
| Insole | Average foot pressure (kpa) | p-value | insole | Average foot pressure (kpa) | p-value |
| Sample 1 | 98.76 | 0.000* | Sample 1 | 102.76 | 0.000* |
| Sample 2 | 96.55 | | Sample 2 | 98.72 | |
| Sample 3 | 93.72 | | Sample 3 | 94.58 | |
| Sample 4 | 108.07 | | Sample 4 | 112.88 | |
| Sample 5 | 125.98 | | Sample 5 | 128.72 | |
| Sample 6 | 126.61 | | Sample 6 | 133.56 | |

*is reliability of $p < 0.05$

The reducing order of the foot pressures at 0 hours and 2 hours at the significance of the reliability of $p<0.05$ among the multi-elastic insole samples 1 to 6 were the insole sample 3, the insole sample 2, the insole sample 1, the insole sample 4, the insole sample 5, and the insole sample 6, as appreciated from Table 4.

B. Comparison of Increasing Rate of the Foot Pressure Among Multi-elastic Insole Samples As listed below in Table 5, the increasing rates of the foot pressures of the multi-elastic insole samples were obtained in accordance with the variation of hours after wearing. First, the insole sample 3 had the lowest increasing rate of 0.85% in the insole samples and the insole sample 2 had a relatively low increasing rate of 2.18%. Also, there was a significant difference at the reliability of $p<0.05$ among the increasing rates of the foot pressures of the multi-elastic insole samples 1 to 6.

TABLE 5

| Insole | hours | Average (kpa) ± standard deviation | p-value | Increasing rate (%) | p-value |
|---|---|---|---|---|---|
| Sample 1 | 0 hours | 98.76 ± 36.60 | 0.714 | 4.00 | 0.696* |
| | 2 hours | 102.76 ± 39.95 | | | |
| Sample 2 | 0 hours | 96.55 ± 31.33 | 0.803 | 2.18 | |
| | 2 hours | 98.72 ± 30.07 | | | |
| Sample 3 | 0 hours | 93.72 ± 16.27 | 0.841 | 0.85 | |
| | 2 hours | 94.58 ± 13.60 | | | |
| Sample 4 | 0 hours | 108.07 ± 16.70 | 0.390 | 4.81 | |
| | 2 hours | 112.88 ± 22.09 | | | |
| Sample 5 | 0 hours | 125.98 ± 23.31 | 0.657 | 2.75 | |
| | 2 hours | 128.72 ± 20.07 | | | |
| Sample 6 | 0 hours | 126.61 ± 24.21 | 0.355 | 6.95 | |
| | 2 hours | 133.56 ± 28.19 | | | |

*is reliability of $p < 0.05$

As listed in Table 5, the foot pressure values of the multi-elastic insole samples were obtained in accordance with the variation of hours at 0 hours and 2 hours after wearing. First, the insole samples 2 and 3 had the lowest foot pressure values having no significant difference at the reliability of $p<0.05$ between them. Also, it could be found that the increasing rates of the foot pressures of the two samples 2 and 3 are lower than the other samples, that is, the insole samples 1, 4, 5 and 6.

It was therefore found that the insole sample 2 having the high, mid and low elasticity polyurethane foams laminated on the tops thereof and the insole sample 3 having the mid, low, and high elasticity polyurethane foams laminated on the tops thereof obtained reduced foot fatigue.

C. Measurement of Electromyogram (EMG)

Measuring the electromyogram (EMG) is possibly carried out by measuring the frequency shift of electromyogram signals. The frequency shift is measured by using a zero crossing rate (ZCR) as the electromyogram signals, and at this case, the frequency shift value becomes high as work load is large.

a) Comparison of Shift of ZCR by Measured Muscles a') Waist Muscles

As shown in Table 6, the shift value of ZCR of the multi-elastic insole samples 1 to 6 was 5.95 Hz, which was lower than that of ZCR of 23.00 Hz of the control group having no insole mounted therein, and it showed a significant difference at the reliability of $p<0.05$.

b') Thigh Muscles

As shown in Table 6, the shift value of ZCR of the multi-elastic insole samples 1 to 6 was 3.27 Hz, which was lower than that of ZCR of 16.08 Hz of the control group having no insole mounted therein, and it showed a significant difference at the reliability of $p<0.05$.

c') Calf Muscles

As shown in Table 6, the shift value of ZCR of the multi-elastic insole samples 1 to 6 was 7.15 Hz, which was lower than that of ZCR of 13.68 Hz of the control group having no insole mounted therein, and it showed a significant difference at the reliability of $p<0.05$.

When the shift values of ZCR by the measured muscles were compared with one another, as appreciated from Table 6, the shift values of ZCR at the all measured muscles in the multi-elastic insole samples 1 to 6 were lower than those of the control group having no insole mounted therein, and also, at all of the measured muscles they showed a significant difference at the reliability of $p<0.05$.

TABLE 6

| Muscles | Insole | Average ± standard deviation (Hz) | Force (F) | p- value |
|---|---|---|---|---|
| Waist | Samples 1~6 | 5.95 ± 4.49 | 23.54 | 0.000* |
| | Control group | 16.99 ± 23.00 | | |
| Thigh | Samples 1~6 | 3.27 ± 2.30 | 41.14 | 0.000* |
| | Control group | 16.08 ± 9.72 | | |
| Calf | Samples 1~6 | 7.15 ± 5.82 | 7.31 | 0.009* |
| | Control group | 13.68 ± 10.59 | | |

*is reliability of $p < 0.05$ b) Comparison of Shift Value of ZCR Among the Multi-elastic Insole Samples As appreciated from Table 7, the shift value of ZCR of the insole sample 2 was 9.19 Hz, which was lowest in the other multi-elastic insole samples 1, and 3 to 6. This means the frequency shift of ZCR from high frequency to low frequency occurs few, which causes low degree of muscle fatigue. Also, the results of the distribution analysis in the multi-elastic insole samples 1 to 6 had a significant difference at the reliability of $p<0.05$.

Therefore, the insole sample 2 had a better result in reducing work load than the other insole samples 1, and 3 to 6.

TABLE 7

| Insole | Average ± standard deviation (Hz) | Force (F) | p- value |
|---|---|---|---|
| Sample 1 | 16.67 ± 15.39 | 4.61 | 0.000* |
| Sample 2 | 9.19 ± 7.23 | | |
| Sample 3 | 14.48 ± 10.16 | | |
| Sample 4 | 12.52 ± 10.11 | | |
| Sample 5 | 15.36 ± 12.91 | | |
| Sample 6 | 11.00 ± 10.66 | | |

*is reliability of $p < 0.05$

D. Results of Analysis of the Measured Foot Pressure and ZCR a) Results of Analysis of the Measured Foot Pressure When the multi-elastic insole samples 1 to 6 were inserted into the shoes, the foot pressure values were decreased, and especially, when 2 hours were passed after wearing, the insole sample 2 showed the lowest increasing rate of the foot pressure in the insole samples.

b) Results of Analysis of the Measured ZCR

When the multi-elastic insole samples 1 to 6 were inserted into the shoes, the shift values of ZCR at the measured muscles were low, and especially, when 2 hours were passed after wearing, the insole sample 2 showed the lowest shift value of ZCR in the insole samples. On the other hand, the insole sample 3 showed a relatively low foot pressure value and a relatively high shift value of ZCR. Further, in the comparison of the shift values of ZCR, there was a significant difference at the reliability of $p<0.05$ among the multi-elastic insole samples 1 to 6.

After analyzing the foot pressures and the shift values of ZCR, it was found that the insole sample 2 with the high, mid and low elasticity foams sequentially laminated on the tops thereof showed the lowest degree of muscle fatigue and the lowest increasing rate of the foot pressure in the insole samples, thereby providing an excellent effect in reducing work load, when compared with the insole samples 1, and 3 to 6.

MODE FOR THE INVENTION

To carry out the above-mentioned solutions, the features of a structure of a multi-elastic insole for shoes according to the present invention are explained with reference to the attached FIGS. 1 to 3.

According to the present invention, there is provided a structure of a multi-elastic insole for shoes including: a low elasticity polyurethane foam 5 disposed on the top side of the insole 1; a high elasticity polyurethane foam 2 and a mid elasticity polyurethane foam 4 sequentially laminated at the inside of a generally oval concaved portion 3 formed on the bottom surface of the insole 1 abutting against a wearer's heel portion; and a foot arch base 6 formed integrally with the insole 1 in such a manner as to be protruded from the middle portion of the insole 1.

When the multi-elastic insole 1 is disposed on the bottom surface of the shoe (which is not shown), the wearer's weight is much collected on the oval concaved portion 3 formed on the bottom surface of the insole 1 abutting against the wearer's heel portion on the low elasticity polyurethane foam 5 formed on the top side of the insole 1, and then, the wearer's body pressure (foot pressure) is distributed by means of the low elasticity polyurethane foam 5. Next, the minute movements of the wearer's muscles are caused by means of the high elasticity polyurethane foam 2 formed at the inside of the oval concaved portion 3, and the impacts are finally absorbed by means of the mid elasticity polyurethane foam 4 disposed beneath the high elasticity polyurethane foam 2 at the inside of the oval concaved portion 3, so that the increasing rate of the foot pressure can be reduced.

The foot arch base 6 that is formed on the top portion of the multi-elastic insole 1 serves to support the load of the wearer's foot generated by the foot pressure, thereby greatly reducing the fatigue of the wearer's foot.

INDUSTRIAL APPLICABILITY

According to the present invention, when the shoes having the structure of a multi-elastic insole are worn, the high, mid and low elasticity polyurethane foams are sequentially laminated on the bottom surface of the insole abutting against a wearer's heel portion, so that the impacts generated from the wearer's foot sole while working for long hours at a state of standing up on a hard floor are all absorbed, thereby making the wearer feel comfortable, which reduces the wearer's leg and foot fatigue and prevents the increasing rate of the foot pressure.

The invention claimed is:

1. A structure of a multi-elastic insole for shoes comprising:

a low elasticity polyurethane foam disposed on a top side of the insole; a high elasticity polyurethane foam and a mid elasticity polyurethane foam sequentially laminated at an inside of a generally oval concaved portion formed on a bottom surface of the insole abutting against a wearer's heel portion; and a foot arch base formed integrally with the insole in such a manner as to be protruded from a middle portion of the insole.

2. The structure of the multi-elastic insole for shoes according to claim 1, wherein the low elasticity polyurethane foam is in a range of resilience from 3 to 10, the high elasticity polyurethane foam is in a range of resilience from 10 to 20, and the mid elasticity polyurethane foam is in a range of resilience from 20 to 30, on the ASTM D2632 resiliometer.

* * * * *